US008348079B2

(12) United States Patent
Baird-Smith et al.

(10) Patent No.: US 8,348,079 B2
(45) Date of Patent: Jan. 8, 2013

(54) APPARATUS AND METHOD FOR CLOSING OFF THE OPEN END OF A CONTAINER WITH A REMOVABLE FLEXIBLE MEMBRANE COVERED BY A RIGID CAP

(75) Inventors: Ian Baird-Smith, Southwell (GB); Andreas Ziegler, Stetten (CH); Reinhart Geisler, Gottmadingen (DE); Werner Hammon, Stockach (DE)

(73) Assignee: Lawson Mardon Sutton Ltd., Nottinghamshire (GB)

( * ) Notice: Subject to any disclaimer, the term of this patent is extended or adjusted under 35 U.S.C. 154(b) by 1597 days.

(21) Appl. No.: 09/445,043

(22) PCT Filed: May 28, 1998

(86) PCT No.: PCT/IB98/00825

§ 371 (c)(1),
(2), (4) Date: Mar. 20, 2000

(87) PCT Pub. No.: WO98/55374

PCT Pub. Date: Dec. 10, 1998

(65) Prior Publication Data

US 2002/0125249 A1 Sep. 12, 2002

(30) Foreign Application Priority Data

Jun. 4, 1997 (GB) ..... 9711462.3

(51) Int. Cl.

| | |
|---|---|
| ***B65D 51/20*** | (2006.01) |
| ***B65D 41/00*** | (2006.01) |
| ***B65D 41/06*** | (2006.01) |
| ***B65D 53/00*** | (2006.01) |

(52) U.S. Cl. ..... 220/258.1; 220/359.1; 220/293; 220/304; 426/401; 426/407; 426/131; 426/113

(58) Field of Classification Search ..... 220/293, 220/258.1, 359.1, 304, 359.4, 203.09, 203.29, 220/203.11, 203.16, 203.18, 258, 296; 426/407, 426/113, 131, 401; 53/490, 485; 215/2
See application file for complete search history.

(56) References Cited

U.S. PATENT DOCUMENTS 365,064 A * 6/1887 Gillingham ..... 220/304
(Continued)

FOREIGN PATENT DOCUMENTS

CH 684077 7/1994
(Continued)

OTHER PUBLICATIONS

Patent Abstracts of Japan, Publication 06219464 of Aug. 9, 1994.

*Primary Examiner* — Robin A. Hylton
(74) *Attorney, Agent, or Firm* — Barbara A. Wrigley; Oppenheimer Wolff & Donnelly, LLP

(57) ABSTRACT

The invention concerns a closure for a cylindrical can (10) The closure includes a flexible member (11) of the easy-open type secured across the open end of the can (10). A rigid, screw cap (22) is screwed over the thus sealed end of the can. An annular, resilient member (24) depending downwardly from the underside of the end wall of the cap (22), engages the membrane (11) in the vicinity of the end flange (18) of the can body (10) thereby strengthening the seal between the membrane (11) and the flange (18). This advantageously permits cooking of the contents of the can with the flexible membrane (11) in situ, thereby giving rise to a can having an easy-open end, the contents of which can are cooked and sterilized using conventional processing lines.

9 Claims, 3 Drawing Sheets

U.S. PATENT DOCUMENTS

| | | | | | |
|---|---|---|---|---|---|
| 1,128,948 | A | * | 2/1915 | Chellis | 220/258 |
| 1,630,687 | A | * | 5/1927 | Aulbach | 220/258.3 |
| 1,862,449 | A | * | 6/1932 | Yeomanson | 220/258 |
| 2,257,715 | A | | 6/1938 | Hopkins | |
| 2,745,755 | A | * | 5/1956 | Anderson | 426/131 |
| 3,079,057 | A | * | 2/1963 | Colarusso | 220/359.3 |
| 3,099,114 | A | * | 7/1963 | Eddy | 229/4.5 |
| 3,108,005 | A | * | 10/1963 | Seiferth et al. | 99/369 |
| 3,122,990 | A | * | 3/1964 | Fried | 99/369 |
| 3,396,899 | A | * | 8/1968 | Strouse et al. | 220/359.4 X |
| 3,805,993 | A | | 4/1974 | Enzie et al. | |
| 3,833,142 | A | | 9/1974 | Owen et al. | |
| 3,885,696 | A | * | 5/1975 | Eberhardt | 220/296 |
| 3,892,351 | A | * | 7/1975 | Johnson et al. | 220/258 X |
| 3,967,746 | A | * | 7/1976 | Botkin | 215/260 |
| 3,973,719 | A | * | 8/1976 | Johnson et al. | 220/258 X |
| 4,044,941 | A | * | 8/1977 | Knudsen | 220/258 |
| 4,295,904 | A | * | 10/1981 | Schmit | 156/160 |
| 4,328,905 | A | * | 5/1982 | Hardt | 220/258 |
| 4,452,842 | A | * | 6/1984 | Borges et al. | 220/359.3 X |
| 4,490,597 | A | * | 12/1984 | Mengel | 219/735 |
| 4,501,371 | A | * | 2/1985 | Smalley | 220/258 X |
| 4,531,649 | A | | 7/1985 | Shull | |
| 4,557,414 | A | * | 12/1985 | Ford et al. | 220/359.2 X |
| 4,683,016 | A | | 7/1987 | Dutt et al. | |
| 4,697,719 | A | * | 10/1987 | Allen | 220/258 |
| 4,856,674 | A | * | 8/1989 | Berney | 220/258 |
| 4,998,638 | A | * | 3/1991 | Kawamata | 426/407 X |
| 5,188,253 | A | * | 2/1993 | Poore et al. | 215/2 |
| 5,664,621 | A | * | 9/1997 | Brophy | 165/4 |
| 5,809,750 | A | * | 9/1998 | Klepsch | 53/137.2 |

FOREIGN PATENT DOCUMENTS

| | | | | |
|---|---|---|---|---|
| DE | 840078 | | 5/1952 | |
| DE | 1176014 | | 8/1964 | |
| DE | 3919835 | * | 8/1990 | 220/296 |
| FR | 2604976 | | 4/1988 | |
| GB | 194670 | | 10/1923 | |
| GB | 374702 | | 6/1932 | |
| GB | 1569106 | | 6/1980 | |
| GB | 2072131 | | 9/1981 | |
| GB | 2123392 | | 2/1984 | |
| JP | 62-122962 | | 6/1987 | |
| JP | 2-231064 | * | 9/1990 | 426/113 |
| WO | 9609968 | | 4/1996 | |

* cited by examiner

APPARATUS AND METHOD FOR CLOSING OFF THE OPEN END OF A CONTAINER WITH A REMOVABLE FLEXIBLE MEMBRANE COVERED BY A RIGID CAP

This invention relates to container assemblies in particular the invention concerns such assemblies including closures known as "easy open ends".

Easy open ends are typically provided in containers that are elongate and, in the unfilled state, open at at least one end. An example of such a container is a metal can.

There are two main types of easy open end. One is made from relatively thick and rigid steel or aluminium, which incorporates a "score" or weakened annular region. This weakened region allows the centre part of the end to be removed, but has the disadvantages that the required opening force is relatively high, making it difficult for less dextrous people to open, and that the ruptured edge is sharp and may cause laceration injuries. The process to form the rivet by which an opening tab may be attached requires many drawing and forming steps. Typically the thickness of steel easy open ends is 0.22 mm or greater, even up to 0.30 mm, depending on the diameter of the closure.

An alternative easy open end typically comprises a flexible, frangible membrane usually of metal foil, or of a laminated material including a layer of metal foil, secured over the open end of a can after filling thereof with eg. a food product. Since the flexible membrane is easily peeled off the can end, it is easy for a user of the can to tear the membrane to gain access to the food product inside the can. The flexible membrane is then usually torn off the can and discarded. Some types of flexible membrane include pull tabs and weakened lines to assist the opening process.

Where a flexible membrane is used there are a number of ways to secure it to the can body. It may be sealed to a ring of aluminium or tinplate or electrolytically chromium coated steel (ECCS), which has been coated with either a layer of flexible polymer such as polypropylene or with a layer of a lacquer which incorporates a quantity of fusible polymer such as polypropylene. To effect a seal the foil membrane (also coated with a layer of fusible polypropylene) is placed over the ring and heat is applied through tools above and below the membrane-ring components. This heat melts one or both of the polymer layers which are then sealed together on cooling. The ring is then attached to the can body by a conventional double seam. In this component the opening is achieved by either breaking the polymer layer to metal adhesion or by breaking within the polymer layer.

An alternative method is to seal the flexible foil membrane directly to the can body, by again heating the membrane and can body until the polymer layers soften sufficiently to melt together and cool to form a homogeneous solid layer, which can then operate as above when opened. It is also possible (but not common) to use an adhesive material to fix the foil on to the can.

Many food products are packed in cans in an uncooked or partially cooked state. On sealing of the cans in food production factories their contents are heated (eg. by steam or steam/air heating) to cook the completely and simultaneously sterilise the interiors of the cans. This process, which has been in widespread use for more than 150 years, allows the safe canning of food products at very high rates of production. However, it has been traditional to employ three piece cans for this process. Both ends of a filled three piece can are substantially rigid. Hence it is necessary to use a can opening machine to open such a can. This is generally considerably slower than opening an easy open end. Also, many people find can opening machines difficult or impossible to use.

It is possible, and indeed is common, to use easy open ends for continuous mass production of canned food products, but these ends are of the more rigid type with relatively high thickness, as described above. What is not currently possible is to use foil sealed cans in a continuous steriliser, without the use of over-pressure to counterbalance the pressure generated inside the can.

It has not previously been possible to employ the flexible membrane-type easy open ends in the continuous mass production of cans the contents of which require cooking in situ. This is primarily because the heating process causes expansion of gases sealed within the cans, and causes further gases to evaporate from the food products, with the result that the seals between the flexible membranes and the can ends burst or, less desirably, leak in a manner that is difficult to detect. Failures of the flexible membranes themselves (as contrasted with the seals) also occur.

One possible solution to these problems lies in the use of an overpressure cooker that is capable of equalising the pressures acting on both sides of the flexible membranes during cooking. This apparatus is disadvantageous, however, since its heating chamber must be sealed and pressurised during the cooking process. Thus the overpressure cooker cannot be used for continuous mass production employing moving conveyor lines.

Thus there is a need for an easy open closure suitable for use in continuous mass production of food products.

U.S. Pat. No. 4,683,016 discloses an easy open end the rigid closure of which includes concentric, downwardly depending annular members that tension the flexible membrane. However, this arrangement only serves to promote a good seal between the container end and the flexible membrane before final curing of the adhesive therebetween. This results in a smooth and well sealed membrane, but would be unlikely to prevent bursting of the seal during cooking since by that stage the strength of the seal depends entirely on the properties of the adhesive material securing the flexible membrane on the container end.

According to a first aspect of the invention there is provided a container assembly comprising an open-ended container and a closure system therefor, including:

(i) a flexible membrane closing the open end of the container;

(ii) a seal between the flexible membrane and the container; and (iii) a rigid closure mounted on the container having a resiliently deformable member juxtaposed to the flexible membrane, the resiliently deformable member pressing the flexible membrane against the container in the vicinity of the seal, thereby reinforcing the seal sufficiently to withstand pressures generated on heating of the contents of the container.

This assembly is advantageous because the resiliently deformable member (reacting against the rigid closure) continuously and evenly reinforces the seal while the rigid closure is mounted on the container. Furthermore, through judicious choice of the material of the resiliently deformable member, the reinforcing pressure applied to the seal may be arranged to increase as the pressure inside the can increases, since this increases the force conferred by the flexible membrane on the resiliently deformable material. This is ideally suited to in situ cooking of the can contents, since the pressure within the can progressively increases for part of the cooking process.

Preferably a container assembly in accordance with the invention includes a container which is a metal, plastic or composite can.

This can advantageously allows the mass production of canned food products that are accessible via easy open ends.

According to a second aspect of the invention, there is provided a method of forming a container assembly in accordance with the invention, comprising the steps of:

(i) securing a flexible membrane on the open end of the container by use of adhesives or heat-sealing, thereby forming a seal;

(ii) engaging the cam and follower of a rigid closure and the container with one another; and (iii) moving the rigid closure and the container relative to one another to cause relative movement between the cam and follower in the predetermined direction, thereby causing the resiliently deformable member to press the flexible membrane against the container in the vicinity of the seal sufficiently to maintain the seal against pressures generated in the container on heating of its contents.

This method is conveniently suited to the mass production of canned food stuffs in existing food factories. The method obviates the need to use pressure cookers to cook food products in cans having easy open ends, and allows production of the filled, sealed cans to occur while the cans move along the conveyor lines of a continuous production apparatus.

According to a third aspect of the invention, there is provided a method of packaging a food product, comprising the steps of placing the food product in an open ended container; closing the open end of the container with a closure to provide an assembly in accordance with the invention and heating the container assembly and the food product therein, the container closure system; maintaining the seal between the flexible membrane and the container during such heating.

According to a fourth aspect of the invention, there is provided a method of packaging a food product comprising the steps of closing an open end of a container having two open ends with a closure to provide a container assembly in accordance with the invention placing a food product in the container; closing the other open end of the container by flanging a container end thereto; and heating the container and the food product therein, the container closure system maintaining the seal between the flexible membrane and the container during such heating.

Further, advantageous features of the invention are defined in the dependent claims hereof.

There now follows a description of preferred embodiments of the invention, by way of example, with reference being made to the accompanying drawings in which.

Figure 1:
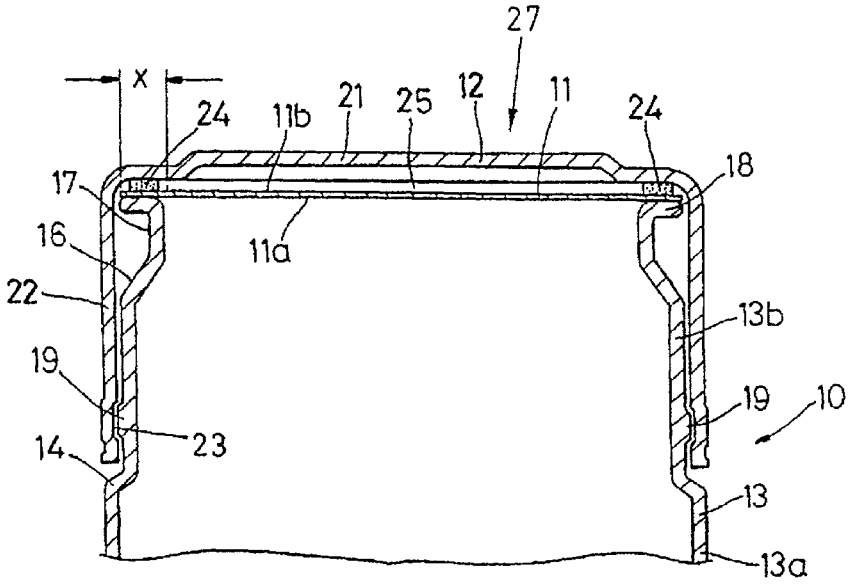
FIG. 1 is a vertically sectioned view of the end of a container assembly comprising a container and closure according to the invention.

Referring to the drawings, there is shown an open ended container in the form of cylindrical metal can 10.

The open end of can 10 is closed off by a flexible prestressed membrane 11 and a rigid cap 12, each of which is described in more detail below.

The body 13 of can 10 is manufactured in a generally conventional manner. Body 13 may be of the one-piece or two-piece types well known in the art of can making. Body 13 is a two-piece body in the embodiment shown.

A short distance from its open end, body 13 is necked inwardly at 14. Thus there is defined a parallel sided main body portion 13*a* of maximum diameter; and a further body portion 13*b*, proximate the open end of the can, of reduced diameter.

The necking (at 14) of the body 13 is defined by an inclined shoulder or chamfer extending about the periphery of can 13. Reduced diameter body portion 13*b* is substantially parallel sided and terminates in a further neck 16 defining a yet further reduced diameter portion 17.

Reduced diameter portion 17 is also substantially parallel sided, and terminates in an outwardly turned, annular flange 18 the outer diameter of which is substantially the same as that of body portion 13*b*.

The cylindrical walls of the body portion portions 13*a*, 13*b* and 17 are substantially parallel to the longitudinal axis of the can 10.

Figure 3:
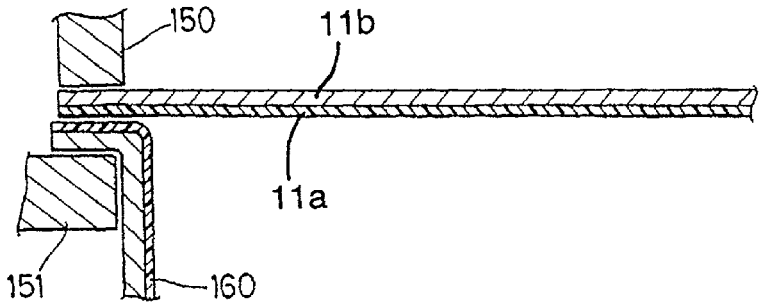
FIG. 3 shows a step in a preferred method of forming the container assembly.

The annular surface of flange 18 remote from body portion 17 faces outwardly at the open end of the can, and is substantially perpendicular to the longitudinal axis of the can. Flexible membrane 11 is adhesively secured to flange 18 by means of eg. an annular strip of heat seal material that cures on heating (typically up to 180° C. for 1 second) thereof. The heat sealing tools 150,151 are shown in FIG. 3. The step of securing the flexible membrane to the open end of the container neck may utilize a heat-sealing method such as heat contact, ultra sonic, induction or hot air.

The radial dimension x of the flange 18 is, typically, 2 to 4 mm in length. The width of the annular band of adhesive material between membranes 11 and flange 18 is of a similar dimension.

In practice the heat seal lacquer material extends over the entire interior surface of the can, as shown at 160 in FIG. 3. The lacquer may be eg. a polypropylene or polyethylene extrusion coating, or could be a PET film.

The membrane 11 may be eg. a metal (eg. aluminum or steel) foil, or a laminated, flexible, composite material such as a layer of metal foil bonded to a layer of paper or a plastic film with a functional barrier layer. In any event, the lower surface 11 a of flexible member 11 is substantially inert, in the sense that it does not contaminate or react with the contents of container 10. The upper surface 11*b* of flexible membrane 11 may be printed with advertising material or user instructions.

Body portion 13*b* has disposed at intervals about its outer periphery a series of cam members in the form of threads 19. Each thread in the embodiment shown lies at the same angle as the adjacent threads, and extends over the same length. In preferred embodiments this length is a few degrees (e.g. 5-10°) of arc. As illustrated schematically in FIG. 1, each thread 19 is formed as an embossment that is slightly proud of the surface of body portion 13*b*. The embossments may be formed in a conventional manner eg. by means of an expanding, rotatable tool insertable through the open neck of can 10 during manufacture thereof, to deform the material of wall portion 13*b* as desired.

The closure of the open end of can 10 includes a rigid cap 12 comprising a laminar member 21. In the embodiment shown, the laminar member is a circular disc, having a cylindrical, annular skirt 22 depending downwardly therefrom.

Annular skirt 22 includes on its outer surface a series of recesses of substantially the same size, angle and length as the threads 19 formed on body portion 13. The recesses 23 appear as embossments on the inner surface of skirt 22. Hence they constitute cam followers in the form of threads complementary to the threads 19. Thus the cap 12, which may be manufactured eg. by deep drawing of a slug of metal using a per se known process, may be screwed onto the end of can 10 through cooperation of the threads 19 and recesses 23.

When cap 12 is screwed onto the open end of can 10 as aforesaid, the angles of the threads relative to the can 10 cause disc 21 to be driven towards membrane 11 on tightening of cap 12.

The underside of disc 21 has adjacent its outermost circumference an annular member 24 secured thereto so as to depend downwardly from the underside of disc 21.

Annular member 24 is formed of a resiliently deformable material, such as an expanded foam, a rubber based formulation, a PVC plastisol or a similar material. It is secured to the underside of disc 21 by virtue of its formation there (eg. by moulding or injection) or, possibly, by adhesive fixing in the cap 12 of a pre-formed sealing ring 24.

As cap 12 is tightened onto can 10, annular member 24 engages membrane 11.

Annular member 24 is located and dimensioned to sandwich a portion of membrane 11 against flange 18, in the vicinity of the adhesive material between membrane 11 and flange 18. Thus on tightening of cap 12, resilient, annular member 24 presses membrane 11 into tight, sealing contact with flange 18. This seal is capable of withstanding pressures developed within the can 10 during cooking of food products therein.

Furthermore, cooking of food products in the can 10 preferably occurs with the cap 12 in the position shown in FIG. 1. In this position, the annular member 24 continues to press down on the seal between membrane 11 and flange 18, thereby providing additional reinforcing of the seal.

In the position shown in FIG. 1, the gap 25 between membrane 11 and disc 21 is of the order of 1-6 mm. Thus the stretching of membrane II that occurs during cooking of food products in can 10 is accommodated by expansion of membrane 11 towards disc 21 that is, as indicated, rigid. Thus the gas pressure within the can is reduced compared with that encountered in conventional cans.

A preferred method of packing a food product in accordance with the invention includes placing food products in an open ended can 10 one end 27 of which is sealed (by virtue of manufacture of the can body as a two-piece body sealed at one end) by a closure to provide a container assembly according to the invention. If appropriate, a suitable modified atmosphere may be added above the level of the food product in the can 10 by conventional apparatus; and then a conventional can end 28 may be secured in a per se know manner by a "flanger", ie a double seaming machine.

Before cooking of the food products, and preferably before the food products are placed in the can, a cap 12 is screwed into the threads 19 of body portion 13b again by machine or by hand as appropriate and tightened down onto the end of can 10 until annular member 24 presses membrane 11 against flange 18 with a predetermined pressure. The moment prior to contact between the components is shown in FIG. 3. The predetermined pressure may be achieved eg. by sensing the torque necessary to rotate cap 12 onto the threads 19.

Thereafter, the can 10 is passed to a suitable cooking apparatus such as a steam, steam/air or water cascade cooker that cooks the food products within the can 10. As is well known, this process kills bacteria in the can rendering the food products safe for long term storage. It also temporarily increases gas pressure in the can, primarily by virtue of expansion of any gas between the food material and the can body; and also through migration of gas molecules from the food products as the food product temperature increases.

The action of annular member 24 ensures that the peripheral seal of membrane 11 is strong enough to withstand the additional pressures generated during cooking. The laminar member is spaced from the flexible membrane by a distance less than the maximum possible extension of the flexible member towards the laminar member. The presence of disc 21 prevents rupture of membrane 11 at locations spaced from flange 18.

In some embodiments the heating process may cause the material of member 24 to change, thereby allowing easy removal of cap 12.

After cooling of the can 10 it may be distributed. A user of the can may then unscrew cap 12 to reveal the membrane 11. Membrane 11 may then be peeled off in order to gain access to the food product within the can.

Figure 2:
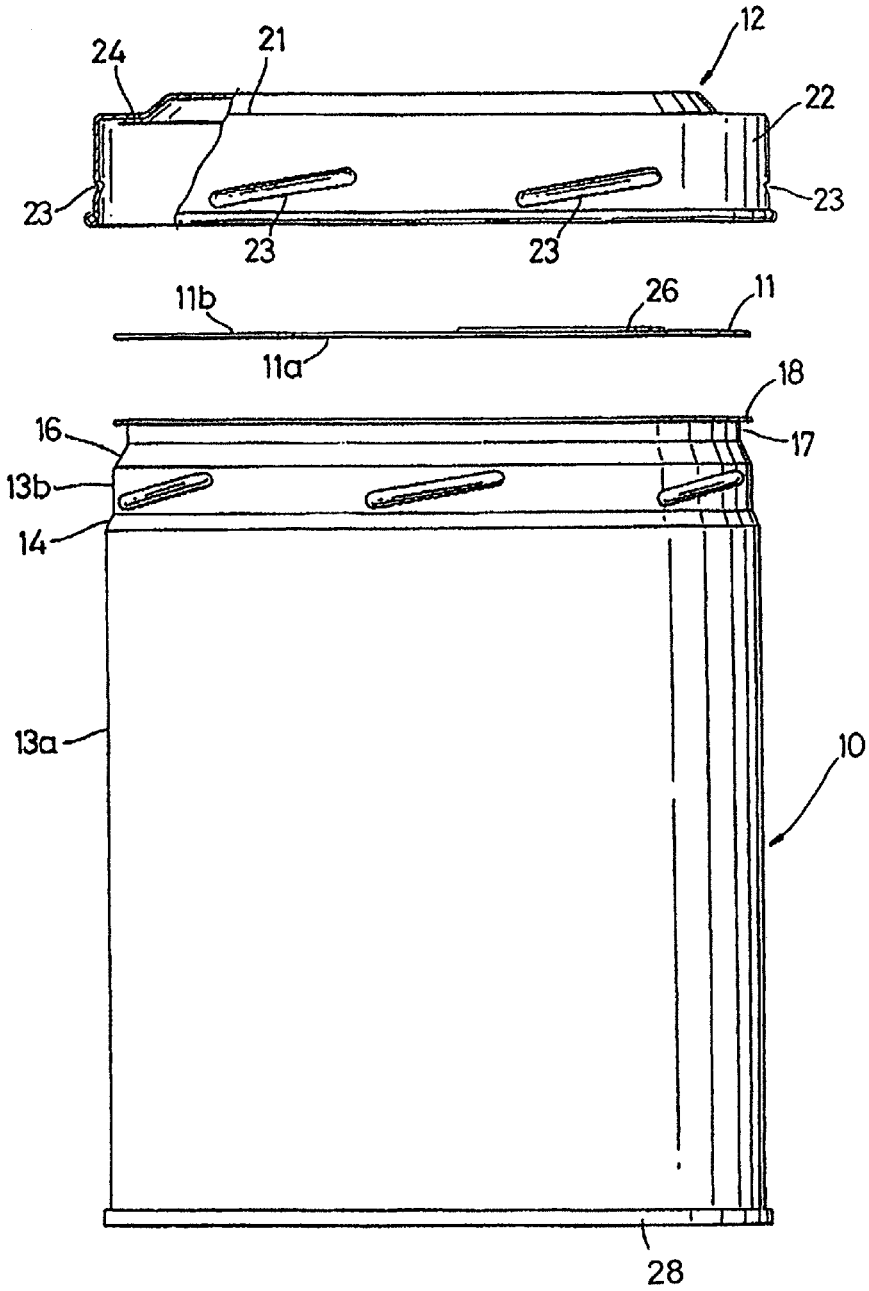
FIG. 2 is a partly-sectioned view showing the components of the FIG. 1 container-assembly.

After peeling membrane 11 may be removed and discarded. Subsequent reclosing of can 10 using cap 12 causes the annular member 24 to engage either flange 18 or an annular portion of membrane 11 remaining adhered thereto, to provide a short to medium term resealing facility thereby extending the life of the food products after opening of the can. FIG. 2 shows an optional pull-off tab 26, formed integrally with membrane 11, that may be provided to assist the opening of the membrane 11. Since the hinge securing the tab 26 is of the same material and thickness as membrane 11, lifting of tab 26 is facilitated.

Thus the invention advantageously provides an apparatus and a method by means of which cooked food products may be provided in metal or other cans having easy open ends.

Furthermore, the process readily lends itself to automation using high speed can making machinery capable of forming cans at rates of perhaps 300 per minute or greater. The quality and integrity of the heat sealing operation can readily be tested and verified.

The neck 14 in the can body 13 provides a neat appearance to the can when cap 12 is secured thereto, since the skirt 22 depending downwardly from disc 21 is of the same diameter as body portion 13*a*. The neck 14 therefore provides for a generally flush appearance to the can end.

Alternatively the cap diameter can be made the same as the seam diameter on the opposing end of the can, so that the can will roll satisfactorily during existing processes. This is shown schematically at 130 in FIG. 4.

Figure 4:
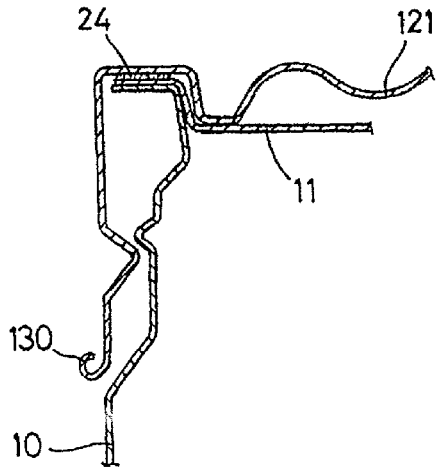
FIG. 4 shows an alternative form of container assembly according to the invention.

FIG. 4 also-shows use of an optional, rippled form 121 of the upper wall of cap 12. This assists in resisting the cooking pressure in a per se known manner.

FIG. 3 shows the membrane 11 in its preferred form, ie. an upper, metal foil layer 11*b* having its lower surface coated with eg. polypropylene 11*a*.

The invention claimed is:

1. A container assembly comprising a closure for an open-ended container, and an open-ended container, the container assembly comprising:

(i) a flexible membrane for closing the open end of the container;

(ii) an adhesive seal between the flexible membrane and the container;

(iii) a rigid cap having a resiliently deformable member juxtaposed to the flexible membrane such that when the cap is in use, the flexible membrane is pressed against the container in the vicinity of the seal, thereby reinforcing the seal sufficiently to withstand high pressures which are generated from cooking the contents of the container;

(iv) the rigid cap further having a first cam and follower pair, which when in use is engaged with a second cam and follower pair located on the container neck, relative movement between the first and second cam and follower pairs in a predetermined direction causes the rigid cap and the container neck to approach one another, thereby increasing the pressure exerted by the resiliently deformable member on the flexible membrane; and (v) the rigid cap further having a laminar member and an annular skirt, the skirt extending downwardly from the laminar member, and the second cam and follower pair is secured on an upper wall of the skirt, wherein the laminar member is spaced from the flexible membrane by a distance less than the maximum possible extension of the flexible membrane towards the laminar member.

2. A container assembly according to claim 1 wherein the first and second cam and follower pairs include co-operating screw threads formed respectively on the container neck and the rigid cap.

3. A container assembly according to claim 1 further having an annular flange, the resiliently deformable member is substantially congruent with the flange, and wherein the rigid cap is in place over the container, the resiliently deformable member presses the flexible membrane against the flange.

4. A container assembly according the claim 1 wherein the laminar member is a circular disc, and the skirt extends from the outer periphery thereof.

5. A container assembly according to claim 1 wherein the resiliently deformable member comprises a foamed material secured to the rigid cap.

6. A container assembly according to claim 1 wherein the flexible membrane comprises a metal foil adhesively securable on the container neck.

7. A container assembly according to claim 3 wherein the rigid cap is shaped for use with the container neck which is generally cylindrical in shape.

8. A container assembly according to claim 1 including a lifting tab hingedly secured to the flexible membrane and is comprised of the same material as that of the flexible membrane.

9. A container assembly according to claim 1 wherein the rigid cap supports the body of the can in a radial direction.

* * * * *